United States Patent [19]

Höhne

[11] Patent Number: 4,622,006

[45] Date of Patent: Nov. 11, 1986

[54] METHOD AND APPARATUS FOR HEAT TREATING METALLIC WORKPIECES USING A CONTINUOUS-HEATING FURNACE OR GRAVITY-DISCHARGE FURNACE

[75] Inventor: Paul Höhne, Kleve, Fed. Rep. of Germany

[73] Assignee: Ipsen Industries International Gesellschaft mit beschränkter Haftung, Kleve, Fed. Rep. of Germany

[21] Appl. No.: 757,271

[22] Filed: Jul. 19, 1985

[30] Foreign Application Priority Data

Jul. 20, 1984 [DE] Fed. Rep. of Germany ... 8421677[U]
Nov. 13, 1984 [DE] Fed. Rep. of Germany ..... 3441338

[51] Int. Cl.[4] ..... F27D 3/00; C21D 1/62; F27B 9/02

[52] U.S. Cl. ..... 432/11; 266/259; 432/128; 432/138; 432/239

[58] Field of Search ..... 432/138, 128, 239, 11; 266/259

[56] References Cited

U.S. PATENT DOCUMENTS

| | | | |
|---|---|---|---|
| 1,783,156 | 11/1930 | Talley | 266/259 |
| 3,598,381 | 8/1971 | Schwalm | 266/259 |
| 4,412,813 | 11/1983 | Wulf | 432/138 |
| 4,496,312 | 1/1985 | Yamada et al. | 432/138 |

FOREIGN PATENT DOCUMENTS

| | | | |
|---|---|---|---|
| 1181924 | 2/1970 | United Kingdom | 432/138 |

*Primary Examiner*—John J. Camby
*Attorney, Agent, or Firm*—Becker & Becker, Inc.

[57] ABSTRACT

A method of heat treating metallic workpieces using a continuous-heating, pusher-type, or gravity-discharge furnace having at least two treatment chambers through which the workpieces successively pass. The chambers, which are provided with doors, serve to respectively heat treat a plurality of workpieces charges, with individual ones of the charges being cyclically received by the respective chambers, being conveyed through the latter while heat treatment is undertaken, and subsequently being released by the chambers. Charges requiring different treatment and/or duration, especially different case-hardening depths during carburization in a two-stage process, can be simultaneously treated while fully utilizing the capacity of the furnace by irregularly conveying the charges in at least one of the treatment chambers in such a way that the charges are released by the chamber or chambers after varying retention times. The apparatus for carrying out the method has a furnace chamber which is divided into several treatment chambers having different temperature and/or furnace atmospheres, and which is provided with a door for loading the workpiece into the furnace chamber and with a door for withdrawing workpieces therefrom. Each treatment chamber is embodied as a rotary-cycle furnace having selectively and cyclically rotatable hearths. Doors are disposed between the respective treatment chambers.

10 Claims, 1 Drawing Figure

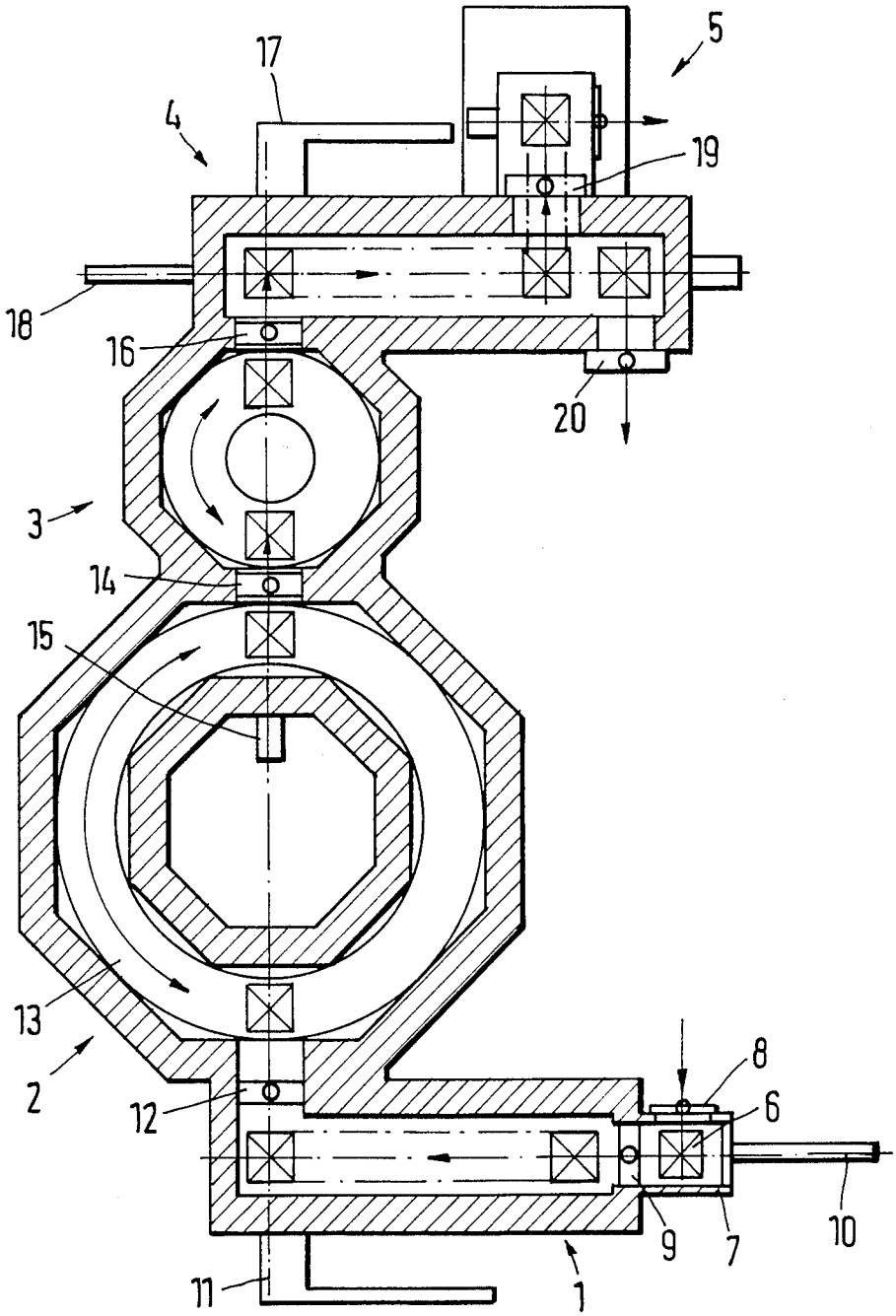
5
17
4
19
18
16
20
3
14
15
13
2
12
8
6
9
7
10
11
1

METHOD AND APPARATUS FOR HEAT TREATING METALLIC WORKPIECES USING A CONTINUOUS-HEATING FURNACE OR GRAVITY-DISCHARGE FURNACE

BACKGROUND OF THE INVENITON

1. Field of the Invention

The present invention relates to a method of heat treating metallic workpieces using a continuous-heating furnace, a pusher-type furnace, or a gravity-discharge furnace having at least two treatment chambers through which the workpieces successively pass; the chambers, which are provided with doors, serve to respectively heat treat a plurality of workpiece charges, with individual ones of said charges being cyclically received by the respective chambers, being conveyed through the latter while heat treatment is undertaken, and subsequently being released by the chambers. The present invention also relates to an apparatus for carrying out this method, especially for the two-stage carburization of metallic workpieces in a controlled atmosphere, and has furnace chamber means which is divided into several treatment chambers having different temperatures and/or furnace atmospheres, and which is provided with a door for loading the workpieces into the furnace chamber means and with the door for withdrawing the workpieces therefrom. A supercarburization is preferably undertaken in the first treatment chamber with a high carbon potential, and a diffusion-decarburization, which leads to the final desired values for the case-hardening depth, is carried out in the second treatment chamber.

2. Description of the Prior Art

Up to now, only gravity-discharge or pusher-type furnaces have been used for this purpose. The drawback with these furnaces is that the treatment time for the individual charges cannot be varied. Each charge which is introduced into the furnace leaves the furnace in an unchangeable sequence after a predetermined period of time. As a result, these furnaces are limited in their application, especially for the treatment of large number of similar workpieces which have to undergo a varied or identical treatment.

Rotary hearth furnaces are also known for heat treating metallic workpieces. With these furnaces, workpieces are introduced through a loading door onto a circular hearth; the workpieces pass through the furnace along a long path in a specific direction of rotation, and after termination of the heat treatment are again removed in the same sequence in which they were loaded (U.S. Pat. No. 4,412,813 Wulf issued Nov. 1, 1983). Such rotary hearth furnaces also operate pursuant to the known gravity-discharge or continuous-heating principle, pursuant to which the retention time of all of the workpieces in the individual stations (treatment chambers) is the same. A further drawback of these heretofore known rotary hearth furnaces is that the furance chamber cannot be divided into a plurality of zones, which for example have different carbon potentials, so that in a practical application, for example for carburization, rotary hearth furnaces can only be used to achieve a case-hardening depth of at most 0.6 mm, since greater case-hardening depths cannot be achieved, or at least cannot be achieved in an economical manner.

An object of the present invention is to provide a method as well as a continuous-heating furnace for heat treating metallic workpieces, whereby, while avoiding the aforementioned drawbacks, it is possible to simultaneously treat charges which require different types and/or duration of treatment, especially for achieving different case-hardening depths during carburization in a two-stage method, while at the same time fully utilizing the capacity of the furnace. The method and apparatus should provide great flexibility in the application of the furnace for simultaneously treating workpieces having varying sizes, shapes, and quantities.

BRIEF DESCRIPTION OF THE DRAWING

These objects, and other objects and advantages of the present invention, will appear more clearly from the following specification in conjunction with the accompanying schematic drawing, which illustrates one inventive embodiment of a continuous-heating furnace for the multi-stage heat treatment of metallic workpieces in a controlled atmosphere, with the two treatment chambers being embodied as rotary-cycle furnaces which have cyclically and selectively rotatable rotary hearths.

SUMMARY OF THE INVENTION

The heat treatment method of the present invention is characterized primarily in that the charges are irregularly conveyed in at least one of the treatment chambers in such a way that the charges are released by the pertaining chamber or chambers after varying retention times.

The inventive apparatus for carrying out this method is characterized primarily in that two of the treatment chambers are embodied as rotary-cycle furnaces having selectively rotatable hearths, with an intermediate door being disposed between the two treatment chambers. Pursuant to a practical embodiment of the present invention, the doors of the apparatus are offset relative to one another by at least 45°, and preferably 180°.

In order to be able to simultaneously heat treat workpiece charges which require a different manner and/or duration of treatment, the critical underlying idea of the present invention is to provide a continuous-heating or gravity-discharge furnace where the treated workpiece charges can be withdrawn in a different sequence than that in which they were loaded. For this purpose, the workpiece charges are irregularly conveyed in at least one of the treatment chambers in such a way that they are released by the pertaining treatment chamber or chambers after varying retention times.

It is therefore possible, for example, to have the individual workpiece charges pass through one of the at least two treatment chambers in the customary manner in an unaltered sequence, i.e. at identical retention times. The other treatment chamber, which is disposed either ahead of or behind the above-mentioned chamber, is embodied as a magazine which is preferably displaceable in two opposite directions of movement, and in the atmosphere of which the heat treatment takes place. The magazine has a plurality of storage places for receiving respective workpiece charges. The magazine can be conveyed or displaced in front of the pertaining door of the heat treatment furnace for loading or discharge. The time period for the loading, the duration of treatment, as well as the time point of withdrawal are controlled pursuant to a prescribed heat treatment program. A magazine of this type can have one or more linear rows of storage places. Pursuant to a further feature of the present invention, however, a rotary hearth furnace is preferably used which is embodied as a rotary-cycle furnace having a rotatable hearth which can be selectively rotated in either direction. The rotary hearth can be loaded regularly or irregularly, and serves as the pertaining treatment chamber. The direction of rotation of the hearth can be abitrarily selected and is a function of where a free place exists or where a charge which is to be withdrawn is located. Normally, an irregular cyclical movement of the hearth is carried out via the automatic control of the treatment and withdrawal. However, irregular cyclical movements can also be undertaken when a large number of similar parts are being treated.

In order to be able to carry out a two-stage carburation process in an advantageous manner to achieve great case-hardening depths of up to 1.8 mm, it is proposed pursuant to an expedient further development of the present invention to embody the furnace chamber as a double rotary-cycle furnace having a first treatment chamber for carburizing at high carbon potential and a second treatment chamber for carrying out a diffusion at a reduced carbon potential. The two chambers, which are embodied as separate rotary-cycle furnaces, are separated by an intermediate door which is preferably disposed on a mutual axis with the loading door and the withdrawal door. To increase flexibility, additional chambers which are also embodied as rotary-cycle furnaces can, in a planetary type arrangement, adjoin the first and/or second chamber. In particular for carrying out heat treatments of parts in the automobile industry, such as transmission parts or motor parts which are individually treated, or also bulk material such as bolts and screws, is expedient to combine the rotary hearth furnace of the invention, which is embodied as a continuous-heating furnace, with respective gravity-discharge or pusher-type furnaces disposed both on the loading side and on the withdrawal side, and which function as preheating chambers and adjustment chambers respectively. In addition, a quenching chamber can in the customary manner adjoin the adjustment chamber.

With a furnace of the inventive type, it is possible to simultaneously run charges having different case-hardening depths. Thus, for example, charges having a case-hardening depth of 0.5 mm and charges having a case-hardening depth of, for example, 1.2 mm can be disposed at the same time in the first chamber (carburization at high carbon potential). In conformity with the different treatment durations required for the two charges, the computer controls the transfer via the intermediate door into the second chamber (diffusion) by means of corresponding differences in terms of time, with the direction or rotation of the hearth being controlled in such a way that the shortest path of movement is used. The overall control of the furnace is undertaken with a computer which takes into account the carbon potentials, the carburization duration, and the diffusion duration at the predeterained treatment temperatures, and further coordinates the loading process with the capacity of the furnace.

DESCRIPTION OF PREFERRED EMBODIMENTS

Referring now to the drawing in detail, when viewed in the direction of movement of the workpieces, the following chambers are arranged one after the other:

A preheating chamber 1 as a gravity-discharge furnace or pusher-type furnace, A carburization chamber 2 as a rotary-cycle furnace, A diffusion chamber 3 as a rotary-cycle furnace, An adjustment chamber 4 as a gravity-discharge furnace or pusher-type furnace, and A quenching or hardening chamber 5.

Taken as a whole, the chambers form a continuous-heating furnace for two-stage carburization of workpieces in a controlled atmosphere. The workpieces, which are disposed on a base structure 6, either individually, on supports, or in baskets, pass into the furnace through a flushing sluice 7, which is provided with a loading bore 8. The flushing sluice 7 is a part of the preheating chamber 1, and atmospherically closes off the latter from the outside air. A flushing process can be carried out when the intermediate door 9 to the chamber 1 is closed.

When the intermediate door 9 is opened, the chamber 1 is loaded by means of a pusher cylinder 10. The charges are cyclically conveyed through the preheating chamber 1, during the course of which they are heated in a carburization-neutral, non-sooting atmosphere to a carburization temperature of 830° to 900° C. The preheating chamber 1 is embodied as a sort of gravity-discharge or pusher-type furnace, with electrical heating means being provided, and the chamber being subdivided into two heating zones (not illustrated). The controlled atmosphere comprises endothermic protective gas and air.

At the left end of the preheating chamber 1 in the drawing, there is disposed a discharge device in the form of a pressure chain; after the intermediate door 12 is opened, the pressure chain 11 pushes the charge into the adjoining carburization chamber 2, which is embodied as a rotary-cycle furnace. The chamber 2 is provided with a rotary hearth 13 which can be selectively rotated in either direction, and has, for example, eighteen places for charges. The rotational movement is cyclically controlled by a computer as a function of the charge; as a consequence of the duration of treatment, the hearth is regularly or irregularly rotated clockwise or counterclockwise. In order to carry out a carburization process having a high carbon potential, the carburization chamber 2 can be heated to 900° C. by means of heating elements disposed in four heating zones. Endothermic gas having a supplementary gas is utilized as the control atmosphere. The charge remains in the carburizing atmosphere in conformity with the time required for achieving a predetermined base-hardening depth; this carburizing atmosphere can be maintained just below the soot limit. After a certain period of time is passed, the charged disposed on the rotary hearth 13 is moved to the withdrawal side, where an intermediate door 14 which leads to the diffusion chamber 3 is opened. A discharge device in the form of a pressure chain 15 pushes the charge into the chamber 3, which is embodied as a smaller rotary-cycle furnace.

The diffusion chamber 3 is provided, for example, with six places for charges. By means of non-illustrated heating elements, a treatment temperature of 900° C. is set, with endothermic gas/supplemental gas-air being utilized as the controlled atmosphere. Computer control assures retention of the charge in the chamber 3 in conformity with the duration of diffusion process along with the individual retention time appropriate for the given charge. By turning the hearth toward the left or toward the right, the charge is then moved along the shortest path toward the withdrawal side, from where, after an intermediate door 16 has been opened, it is conveyed into the adjustment chamber 4 by means of a chain 17.

The adjustment chamber 4 is embodied as a type of gravity-discharge or pusher-type furnace. The chamber 4 is provided with heating elements which are disposed in two zones (not illustrated) and which make it possible to set a desired temperature, for example 850° C. in order to reduce the temperature of the charge to the hardening temperature. Endothermic gas/supplemental gas plus air is utilized as the controlled atmosphere.

The temperature of the charge is reduced in the adjustment chamber 4 to the hardening temperature in an atmosphere which corresponds to the desired carbon content of the surface. A pusher cylinder 18 again serves to convey the charge through the furnace. After the reduction of the temperature has taken place, an adjustment of the charge to the hardening temperature has been achieved, the charge reaches one of the two withdrawal positions illustrated in the upper right hand corner of the drawing. The charge is either conveyed by a built-in cold chain drive 19 along the path illustrated by dot-dash lines onto a lowering platform of an oil quenching bath of the hardening or quenching chamber 5, or an individual withdrawal of charges is carried out through the slotted door 20.

With the described inventive furnace, it is economically possible to individually carburize in two stages various workpieces based on the material, shape, size, and quantity thereof, so that the advantages of heretofore known gravity-discharge or pusher-type furnaces, namely fully automatic operation and high rates of heating, can be combined, while maintaining two-stage carburization, with the advantages of a rotary-hearth furnace while providing a high degree of flexible.

The present invention is, of course, in no way restricted to the specific disclosure of the specification and drawing, but also encompasses any modifications within the scope of the appended claims.

What I claim is:

1. A method of heat treating metallic workpieces using a continuous-heating, pusher-type, or gravity-discharge furnace having at least two treatment chambers through which the workpieces successively pass; the chambers, which are provided with doors, serve to respectively treat a plurality of workpiece charges, with individual ones of said charges being cyclically received by the respective chambers, being conveyed through the latter while heat treatement is undertaken, and subsequently being released by said chambers;

the improvement therewith which comprises the steps of:

irregularly conveying said workpiece charges in at least one of said treatment chambers;

heat-treating said charges in said at least one of said treatment chambers;

varying retention times of the charges in said at least one of said treatment chambers wherein said heat treating is undertaken;

then releasing said charges from said at least one of said treatment chambers; and thereafter introducing said charges into another of said heat treatment chambers for further heat treating and subsequently conveying another of said charges into said at least one of said heat treatment chambers;

said charges being released from said at least one treatment chamber only after said heat treating and said varying retention times.

2. A method according to claim 1, which includes the steps of using, as said at least one treatment chamber, respective rotary hearth furnaces embodied as respective rotary-cycle furnaces each having a hearth; and cyclically and selectively rotating the hearth in either direction of rotation thereof, with movement cycle thereof being either regular or irregular.

3. A method according to claim 2, which includes the steps of: using a double rotary-cycle furnace having a first treatment chamber for said heat treating that includes carburizing at high carbon potential, and having a second treatment chamber for carrying our said further heat treating that includes a diffusion at a reduced carbon potential;

embodying each of said treatment chambers as a separate rotary-cycle furnace; and separating said first and second treatment chambers by door means including an intermediate door for moving said charges therethrough after said releasing from said first treatment chamber and thereafter introducing said charges into said second treatment chamber.

4. A method according to claim 3, in which said door means include a loading door movable for said first treatment chamber, and a withdrawal door movable for said second treatment chamber; and which includes the step of disposing said intermediate door, said loading door, and said withdrawal door on a common axis of movement.

5. An apparatus for heat treating metallic workpieces using a continuous-heating, pusher-type, or gravity-discharge furnace having furnace chamber means and divided respectively by structural means into several treatment chambers having different temperatures and/or furnace atmospheres, and including a loading door movable relative to said structural means for loading said workpieces into said chamber means and with a withdrawal door movable relative to said structural means for withdrawal workpieces therefrom; the improvement therewith comprising:

two of said treatment chambers being embodied as respective rotary-cycle furnaces each having a means for selectively and cyclically rotatable movement of a hearth therewith; and a further intermediate door movably disposed with respect to said structural means disposed between said two treatment chambers which are embodied as rotary-cycle furnaces.

6. An apparatus according to claim 5, in which said loading door, said withdrawal door, and said intermediate door are offset by at least 45° relative to one another.

7. An apparatus according to claim 6, in which said doors are offset by 180° relative to one another.

8. An apparatus according to claim 5, which includes further treatment chambers, each in the form of rotary-cycle furnaces, disposed in a star-shaped arrangement collectively with respect to each other and adjoining at least one of said first two treatment chambers which are embodied as rotary-cycle furnaces.

9. An apparatus according to claim 5, in which said furnace chamber means includes respectively a loading side and a withdrawal side therewith; and which includes a pusher-type furnace respectively on said loading side as a preheating chamber therewith and a pusher-type furnace respectively on said withdrawal side as an adjustment chamber therewith, said charges selectively and sequentially moving first through said pusher-type furnace on said loading side and then through the pusher-type furnace on said withdrawal side.

10. An apparatus according to claim 9, which includes a quenching chamber which is connected to said adjustment chamber.

* * * * *